United States Patent [19]

Matthews

[11] 4,197,802

[45] Apr. 15, 1980

[54] LINKING MACHINES

[75] Inventor: Denis Matthews, Sutton-in-Ashfield, England

[73] Assignee: Mathbirk Limited, Sutton-in-Ashfield, England

[21] Appl. No.: 916,747

[22] Filed: Jun. 19, 1978

[30] Foreign Application Priority Data

Jul. 12, 1977 [GB] United Kingdom ..... 29150/77

[51] Int. Cl.[2] ..... D05B 7/00; D05B 27/00

[52] U.S. Cl. ..... 112/27; 112/136

[58] Field of Search ..... 112/136, 148, 150, 152, 112/153, 27

[56] References Cited

U.S. PATENT DOCUMENTS

| | | | |
|---|---|---|---|
| 112,327 | 3/1871 | Dufour | 112/153 |
| 891,843 | 6/1908 | Lee | 112/153 |
| 1,366,420 | 1/1921 | Ringe | 112/136 |
| 1,526,933 | 2/1925 | Rhyon | 112/136 |
| 1,679,363 | 8/1928 | Kohler | 112/149 |
| 2,011,492 | 8/1935 | Kucera | 112/152 |
| 2,329,991 | 9/1943 | Kellum | 112/136 |
| 2,546,135 | 3/1951 | Reid | 112/136 |
| 2,619,923 | 12/1952 | De Sha | 112/149 |
| 2,706,456 | 4/1955 | Stangler | 112/152 |
| 3,905,316 | 9/1975 | Mall | 112/153 |

*Primary Examiner*—Ronald Feldbaum
*Attorney, Agent, or Firm*—Frailey & Ratner

[57] ABSTRACT

A fabric guide device for a linking machine having a rotatable circle of radially extending points. The device guides fabrics, which are to be joined by a chain stitch, onto the points so that the fabric edges are located at a predetermined height relative to the points. The device includes at least one pair of opposed guide surfaces for engaging slidingly opposite sides of a fabric adjacent an edge thereof. Adjustable reference surfaces locate selectively the height of the fabric edges relative to the points. The device is particularly useful in the joining together of patterned fabrics. It permits fabrics which are to be joined to be held in correct pattern position relative to each other, so that adjacent parts of the pattern are impaled upon the same points. When the seam is made, the pattern shows a correct join.

14 Claims, 7 Drawing Figures

LINKING MACHINES

This invention relates to linking machines.

The invention is particularly concerned with that kind of linking machine in which the fabric to be joined together is impaled upon radially extending points and presented to an imperforate hooked needle which pierces the fabric and which then has thread wrapped around it, on the far side from that on which the needle enters the fabric and as it withdraws through the fabric the needle forms a single chain stitch. Machines of this kind are described in my earlier co-pending U.S. patent applications Ser. No. 865,251 filed Dec. 28, 1977 and Ser. No. 914,233 filed June 8, 1978. Such machines may incorporate twin or multi needles as well as attachments for severing fabric beyond the stitch which has been formed by a single or twin needle and which seam is then subsequently secured by an oversew stitch of a single chain stitch variety.

The present invention is concerned with such machines and with fabric guide devices for running the fabrics to be joined together onto the radially extending points. It will be appreciated that particularly where joining together fabric having a pattern it is necessary for the two pieces of fabric to be accurately held in correct relationship to each other so that the adjacent parts of the pattern are impaled upon the same radially extending points, so that when the seam is made the pattern shows a correct join. Various devices are known for assisting the running of fabrics onto points but the difficulty is primarily in holding the fabric at the right disposition relative to the points as it is run out.

It will be appreciated that such a device has to be adapted to suit fabrics of different thicknesses and different size of stitches and it will also be appreciated that an unselvedged edge tends to curl so that the said device has to have the ability of uncurling the unselvedged edge of the fabric which is to be joined. Furthermore such a device desirably is able to deal with two fabrics to be joined which have different characteristics of stretch.

According to the present invention there is provided a fabric guide device for use in feeding fabric to the radially extending points of a linking machine, the device including a support adapted for attachment to the machine, and fabric guide means carried by the support, the guide means being adapted to co-operate in use with an edge of the fabric so as to guide the fabric edge at a predetermined dispostion relative to the points of the machine.

Reference is now made to the accompanying drawings in which.

Figure 4:
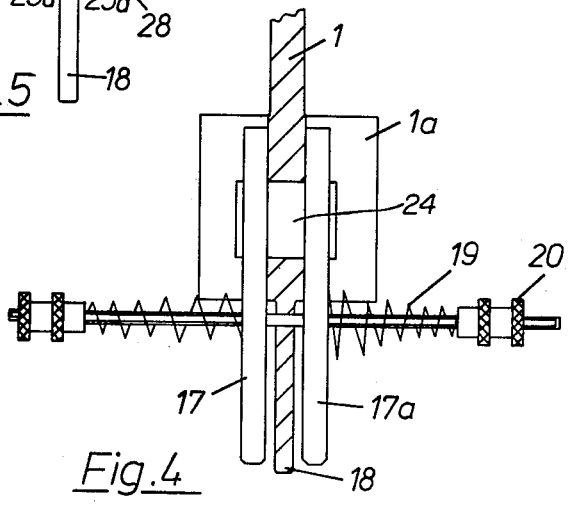
FIG. 4 is a cross-sectional view on the line 4—4 of FIG. 2.

Referring initially to FIGS. 1 to 5, the guide device 100 includes a support or arm 1 having a central web or flange 18 (FIG. 4). The arm 1 is pivotally mounted by a bolt 4 on an arm 2 of a frame 101. The frame 101 is secured to a frame 13*a* of a linking machine by means of bolts 14. Frame 101 includes a first member 13 which slidably supports a second member 12 which is slidable in a slide by a bolt 15 in a horizontal manner. Slidable relative to second member 12 in a vertical manner is a third member 22 as seen more clearly in FIG. 3. The third member 22 carries the arm 2. The relative vertical adjustment of third member 22 relative to the second member 12 is obtained by means of a knurled knob 23 acting with a screw into a tapped hole. The arm 2 also carries a wedge in the form of a tapered prong 3 for a purpose herein after further described. From a drive of the linking machine an eccentric 5 operates a rod 6 for reciprocating a crank 8 pivoted about a shaft 7 extending through the first member 13 and having at its lower end a pusher blade 9 adapted to tap or encourage fabric 11*a* and 11*b* onto the points 10 which extend radially of the machine.

Each piece of fabric 11*a* and 11*b* is located between opposed guide surfaces formed on the central web 18 and a respective one of a pair of flanges 17*a* and 17 which are urged towards the central flange 18 by a coil spring 19 whose tension may be adjusted on a threaded rod by a nut 20. The flanges 17 and 17*a* each have an extending portion which when the arm 1 is swung to the position illustrated in FIG. 3 engages the tapered prong 3 and opens out the flanges or separates them from the central web 18. In the position illustrated in FIG. 3 the flanges 17 and 17*a* are thus opened out enabling the fabric 11*a* and 11*b* to be inserted between the flanges 17 and 17*a* and the central web 18. After locating the fabric to be joined the arm 1 is swung to the position illustrated in FIG. 2 which is the position in which the fabric is then fed towards the radially extending points 10 and is tapped onto the points by means of the pusher blade 9.

The flanges 17 and 17*a* are slidable relative to the arm 1 which between the upper portion of arm 1 and the central flange 18 has a square section portion 1*a* integral therewith which defines a central aperture 24 into which the tapered prong 3 extends in order to separate the flanges 17 and 17*a*. At each side of the square section portion 1*b* there is a slide 25 which has an 'L' shaped portion 28 which extends towards the central web 18 and defines a reference surface 25*a* against which the edge of fabric slidably abuts. The purpose of this is to adjust the height of the edge of the fabric trapped between the central web 18 and either of the flanges 17 and 17*a* relative to the points.

Figure 5:
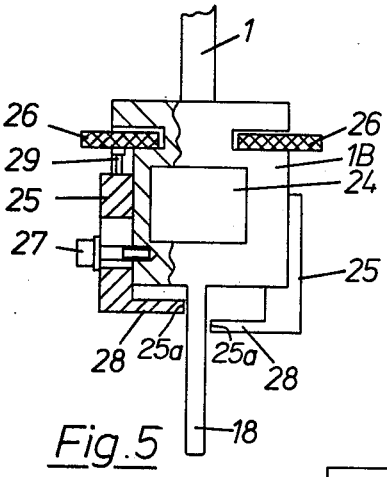
FIG. 5 is a part sectional end view of the device of FIG. 1.

As illustrated in FIG. 5 one of the slides 25 may be adjusted to a different height from the other in order to ensure adequate or more precise matching of the pattern of the fabric or for any other reason. Each slide 25 is movable in a vertical direction by rotation of a knurled wheel 26 operating a threaded rod 29 to move the slide 25 up or down. The slide 25 is secured against further movement in its desired position by a screw 27 engaging into the part 1*b* of the arm 1.

It will be appreciated that by having the flanges 17 and 17*a* movable relative to the central flange 18 that the device is readily able to assist the running on of fabrics of different thickness and by providing a vertical adjustment of the slides 25, fabric matching is furthermore assisted where the pattern repeat is not the same distance from the edge for the two fabrics to be joined.

Figure 6:
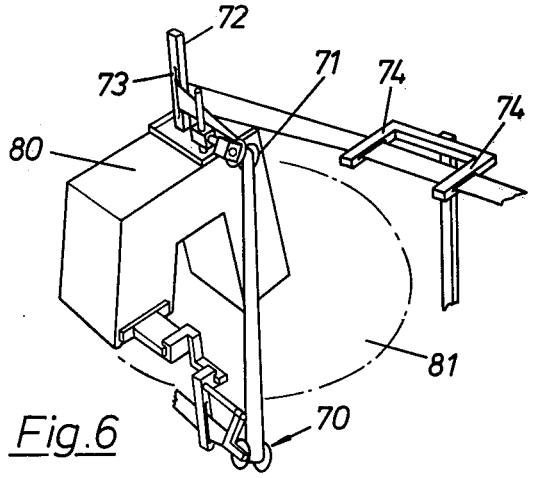
FIG. 6 is a schematic perspective view of a linking machine fitted with another fabric guide device according the present invention.
Figure 7:
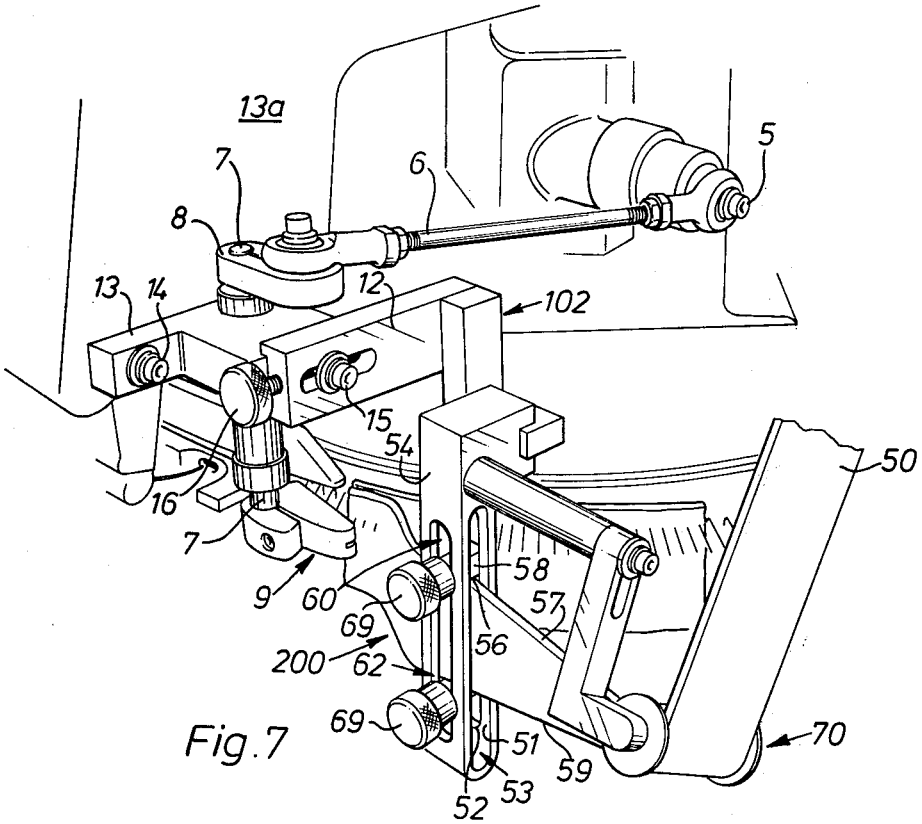
FIG. 7 is a perspective view of the device shown in FIG. 6.

Reference is now made to FIGS. 6 and 7 in which another guide device 200 is shown. The guide device 200 is particularly useful in guiding continuous lengths of knotted fabric 50 normally used for edging purposes in garments, for example, cardigans.

The guide device 200 includes a pair of opposed guide surfaces 51, 52 formed by opposite sides of a slot 53 formed in guide arm 54. An upper reference surface 56 for guiding the upper edge 57 of fabric 50 is formed on a bar 58 slidably received for vertical adjustment in slot 60. Also slidably received in slot 60 is a bar 62 having a lower reference surface (not visable) for guiding the lower edge 59 of the fabric 50. Both bars 58 and 62 are releasibly held in position by a knurled nut 69.

Figure 1:
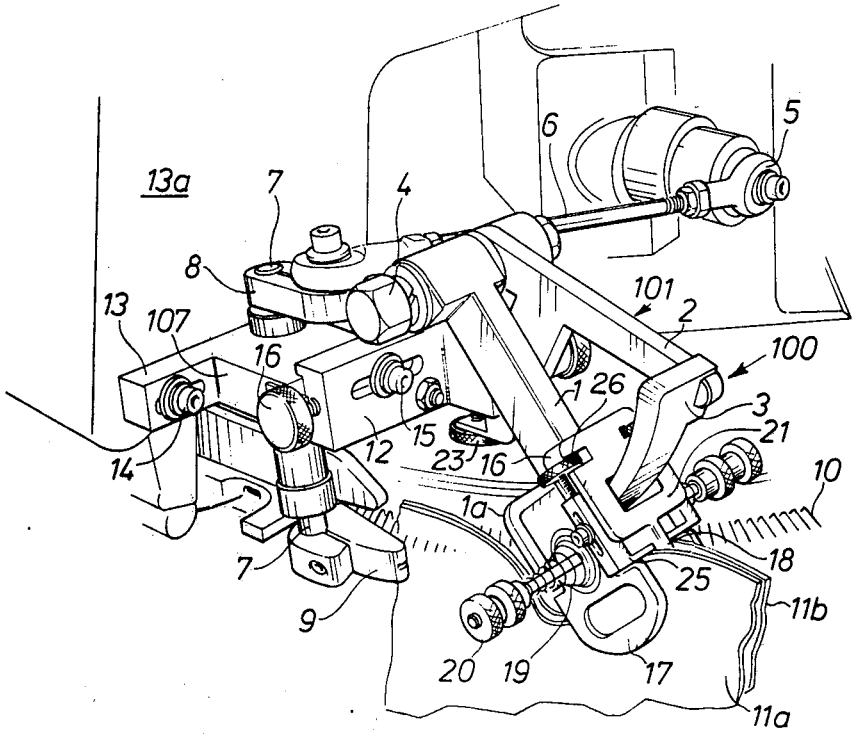
FIG. 1 is a perspective view of a fabric guide device according to the present invention for use with a linking machine.
Figure 2:
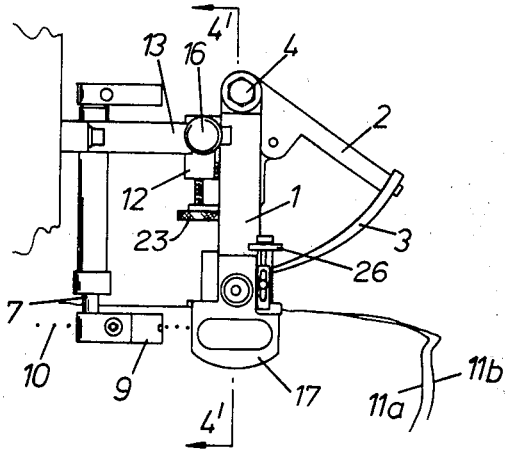
FIG. 2 is a side view showing the device of FIG. 1 in its operative position.
Figure 3:
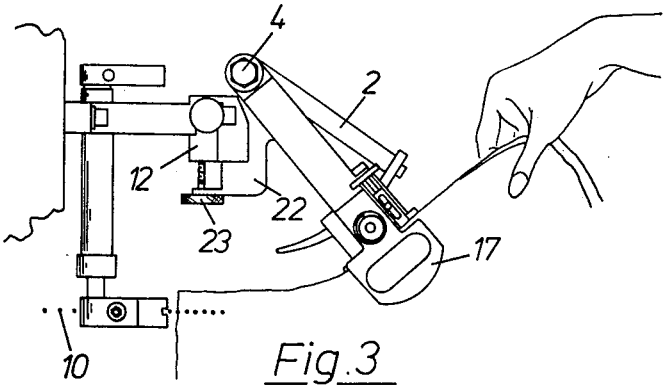
FIG. 3 is a side view showing the device of FIG. 1 in its loading position.

The arm 54 is secured to a frame 102 similar to the frame 101 of the embodiment of FIG. 1, like parts being designated by the same reference numerals. Fabric 50 is fed to the guide arm 54 from a source of the knitted fabric (not shown) via a pair of bobbins 70, 71, a guide arm 72 having a guide slot 73 formed therein and a pair of guide arms 74.

The sewing machine 80 is arranged to rotate about the same axis as the point dial 81 and the guide arm 72 is arranged to be co-axial and bobbins 70, 71 are secured to the machine so that rotation of the linking machine does not affect the feed of the fabric to the guide arm 54. If desired, tensioning means (not shown) may be provided to impose a slight tension on the fabric as it is being fed onto the points.

It will be appreciated that the device 200 may be used in conjunction with device 100 so that fabric may be fed onto the dial by device 100 prior to reaching device 200 which then feeds additional fabric onto the dial, or vice versa.

It will also be appreciated that the opposed surfaces 51, 52 may be adjustable relative to one another so as to vary the spacing therebetween for accommodating fabrics of different thicknesses.

What I claim is:

1. In a linking machine having a plurality of radially extending points for implament of fabrics to be joined by a chain stitch, a fabric guide device for feeding fabric to the points whereby the fabric is impaled on the points so as to locate an edge of the fabric at a predetermined height relative to the points, said device including a support for attaching the device to the machine, fabric guide means carried by the support to guide the fabric to the points, said guide means including a moveable reference surface against which said fabric edge slidingly abuts as the fabric is guided to the points, said reference surface being operable to locate the fabric edge at the predetermined height relative to the points, and adjustment means for moving the reference surface selectively relative to the guide means.

2. A device according to claim 1 wherein the guide means includes a pair of opposed guide surfaces for engaging opposite sides of the fabric adjacent said edge.

3. A device according to claim 2 wherein the guide means includes two pairs of opposed guide surfaces for guiding two pieces of fabric side-by-side to said points.

4. A device according to claim 2 or 3 wherein the opposed surfaces of the or each pair are mounted so as to be relatively movable toward one another.

5. A device according to claim 4 wherein one of the opposed surfaces of the or each pair is fixed and the other surface is movable, said other surface being resiliently biassed by biasing means toward said one surface.

6. A device according to claim 5 wherein the biasing means is adjustable.

7. A device according to claim 6 wherein said one of the opposed surfaces is formed on a support member and the other of the opposed surfaces is formed on a flange carried by the support member.

8. A device according to claim 7 wherein the biassing means urging the flange towards the support member is a coil spring.

9. A device according to claim 7 including means for moving the or each flange away from the support member in order to separate the opposed surfaces of each pair to permit introduction of fabric therebetween.

10. A device according to claim 9 wherein the support member is movably mounted on a frame for movement between a fabric loading position and a fabric feeding position, the frame being adapted for attachment to the linking machine, the frame supporting a wedge member for co-operation with the support member and flanges so that on movement of the support member to the loading position the flanges are moved away from the support member.

11. A device according to claim 10 wherein the support member is pivotally mounted on the frame.

12. A device according to claim 2 wherein the guide means includes a further reference surface opposed to said reference surface, the further reference surface being arranged to slidingly engage an edge of the fabric opposite to said first mentioned edge.

13. A device according to claim 12 wherein the opposed surfaces are fixed relative to one another.

14. A linking machine according to claim 1 having a dial of points and being rotatably mounted on a support structure for rotation about the axis of the dial, a fabric guide system being provided for guiding a continuous length of fabric from a source to fabric guide means, the guide system including a guide member positioned coaxially on the machine to receive fabric from said source so that the feed of fabric to the guide means is unaffected by the rotational position of the sewing machine relative to the source.

* * * * *